US010969185B2

(12) United States Patent
Green

(10) Patent No.: US 10,969,185 B2
(45) Date of Patent: Apr. 6, 2021

(54) SYSTEM FOR SIMULATING THE RELOADING OF A MAGAZINE IN A MAGAZINE FED HAND OPERATED DEVICE FOR A SIMULATION

(71) Applicant: David Green, Westminster, CA (US)

(72) Inventor: David Green, Westminster, CA (US)

(73) Assignee: Altered Mechanics, Westminster, CA (US)

( * ) Notice: Subject to any disclaimer, the term of this patent is extended or adjusted under 35 U.S.C. 154(b) by 0 days.

(21) Appl. No.: 16/752,899

(22) Filed: Jan. 27, 2020

(65) Prior Publication Data

US 2020/0240730 A1 Jul. 30, 2020

Related U.S. Application Data

(60) Provisional application No. 62/796,692, filed on Jan. 25, 2019.

(51) Int. Cl.
*F41A 33/00* (2006.01)
*F41A 17/38* (2006.01)
*F41A 9/61* (2006.01)

(52) U.S. Cl.
CPC ..... *F41A 17/38* (2013.01); *F41A 9/61* (2013.01)

(58) Field of Classification Search
CPC ..... F41A 33/00; F41A 17/34; F41A 17/36; F41A 17/38
USPC ..... 434/11, 16, 18, 24
See application file for complete search history.

(56) References Cited

U.S. PATENT DOCUMENTS

| | | | | |
|---|---|---|---|---|
| 8,777,620 | B1 * | 7/2014 | Baxter | F41G 3/26 434/16 |
| 8,899,985 | B2 * | 12/2014 | Walls | F41B 11/62 434/24 |
| 9,261,320 | B2 * | 2/2016 | Campbell | F41A 17/34 |
| 9,291,420 | B1 * | 3/2016 | Jensen | F41A 19/01 |
| 9,435,604 | B2 * | 9/2016 | Zusman | F41A 33/00 |
| 10,436,540 | B2 * | 10/2019 | Bascom | F41A 33/06 |
| 2008/0127538 | A1 * | 6/2008 | Barrett | F41A 9/62 42/1.02 |
| 2009/0253103 | A1 * | 10/2009 | Hogan, Jr. | F41A 33/02 434/24 |
| 2011/0283586 | A1 * | 11/2011 | Scallie | F41A 33/00 42/84 |
| 2012/0329364 | A1 * | 12/2012 | Botten | F41A 33/00 446/405 |
| 2015/0260474 | A1 * | 9/2015 | Rublowsky | A63F 13/213 434/16 |
| 2016/0245610 | A1 * | 8/2016 | Schulz | F41A 9/65 |
| 2017/0082390 | A1 * | 3/2017 | Morgan | F42B 8/08 |

(Continued)

*Primary Examiner* — Kurt Fernstrom
(74) *Attorney, Agent, or Firm* — Kenyon Jenckes

(57) ABSTRACT

A system that enables a user to simulate the reloading of a magazine fed hand operated device used in a simulation. The user may eject the physical magazine using the magazine ejection button on the hand operated device, and then engage that same magazine which has been stopped from being fully ejected from the hand operated device's magazine housing by a magazine retention mechanism. An internal magazine engagement sensor registers with the simulation that the magazine has been ejected by the user and then has been re-engaged when the magazine is fed back into the housing and locked in by the hand operated device's locking mechanism.

7 Claims, 3 Drawing Sheets

(56) References Cited

U.S. PATENT DOCUMENTS

| | | | | |
|---|---|---|---|---|
| 2017/0234641 | A1* | 8/2017 | Farrell | F41A 17/46<br>434/16 |
| 2017/0307332 | A1* | 10/2017 | Ooi | F41G 3/06 |
| 2018/0128570 | A1* | 5/2018 | Sawicki | F41A 9/65 |
| 2018/0356175 | A1* | 12/2018 | LaMons | F41A 99/00 |

* cited by examiner

SYSTEM FOR SIMULATING THE RELOADING OF A MAGAZINE IN A MAGAZINE FED HAND OPERATED DEVICE FOR A SIMULATION

CROSS-REFERENCE TO RELATED APPLICATION

This application claims priority to US Provisional Patent Application 62/796,692, entitled "NOVEL SYSTEM FOR SIMULATING THE RELOADING OF A MAGAZINE IN A MAGAZINE FED HAND OPERATED DEVICE FOR A SIMULATION", filed Jan. 25, 2019.

FIELD OF THE INVENTION

A system for simulating the reloading of a magazine for a magazine fed hand operated device for use in a computer simulation.

BACKGROUND

When simulating the reloading of a weapon or tool for computer driven software simulations using a physical hand operated device in a simulated environment, the user will have the option of pressing a button to indicate a reload has happened or having the software simulation automatically perform a reload with no user action on the physical hand operated device.

This is far removed from the real-life experiencing the reloading of a hand operated device where the user must eject a magazine using the mechanical magazine eject button, and then engage a new, loaded, magazine into the magazine housing of the hand operated device.

Accordingly, it would be advantageous to provide a user with an apparatus or system that provides a more realistic experience when using a magazine reloadable hand operated device in a simulated environment

SUMMARY

Disclosed is a system that enables a user to simulate the reloading of a physical magazine fed hand operated device, such as but not limited to, a weapon or tool used in a computer simulation. This is done by ejecting the physical magazine using the magazine ejection button on the hand operated device and then engaging that same magazine which has been stopped from being fully ejected from the hand operated device's magazine housing by a magazine retention mechanism, e.g., external flanges on the outer body of the magazine housing and a retention device connected to the magazine including interference flanges to engage the flanges on the magazine housing to prevent full ejection of the magazine.

Internally a magazine engagement sensor is used to register with the simulation that the magazine has been ejected by the user and then been re-engaged when the magazine is fed back into the housing and locked in by the hand operated device's locking mechanism.

DETAILED DESCRIPTION

Figure 1:
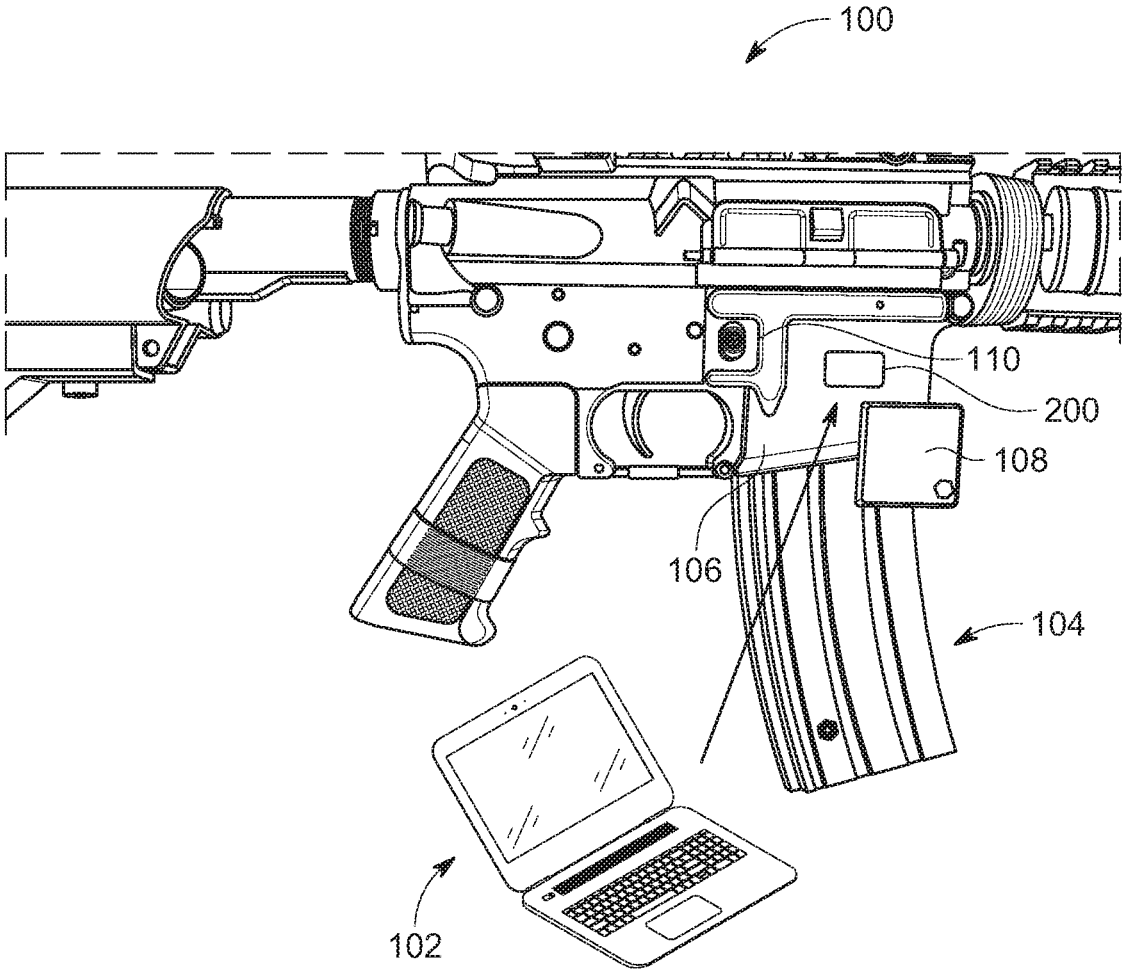
FIG. 1 is a plan view of a hand operated device, in this case, a rifle including a retention device according to an embodiment.

FIG. 1 shows a hand operated device 100, in this example a rifle, for use in a computer simulation according to an embodiment. The hand operated device 100 may be connected to a computer 102 running the simulation via a wired, e.g, a USB (Universal Serial Bus) cable, or wirelessly, e.g., Bluetooth (IEEE 802.15) or WiFi (IEEE 802.11), infra-red (IR), etc.

A user may find it desirable to mimic a real world experience when engaging in a computer simulation provided by a computer, e.g., a gaming rifle 100, as shown in FIG. 1, or other hand operated device employing the ejection and reloading of a magazine 104, e.g., a hand gun, nail gun, or any imagined or futuristic weapon that requires a magazine of cartridges. Further, although not necessarily, the rifle may have the feel and weight of an actual rifle of the same type to provide a realistic feel of holding, loading, ejecting, and reloading a magazine.

The magazine 104 may be engaged into the hand operated device by the user pushing the magazine 104 up into a magazine housing 106. The magazine retention device 108 may then lock the magazine 104 in place.

Figure 2:
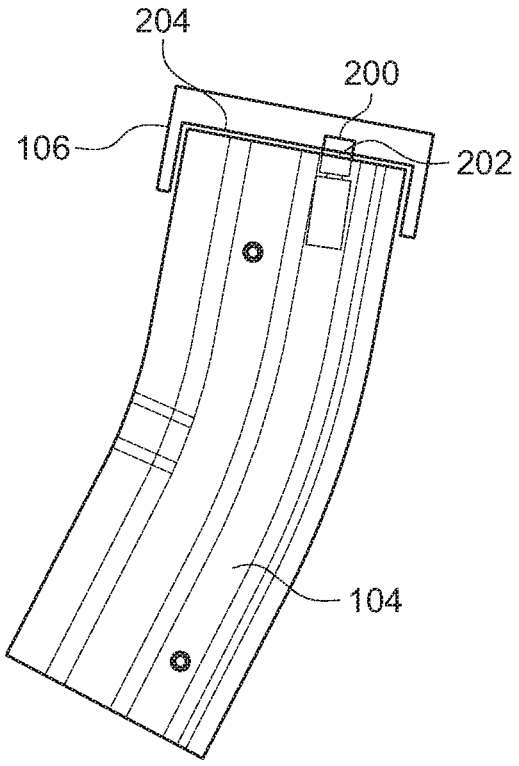
FIG. 2 is a sectional view of a magazine in an engaged position magazine housing according to an embodiment.
Figure 3:
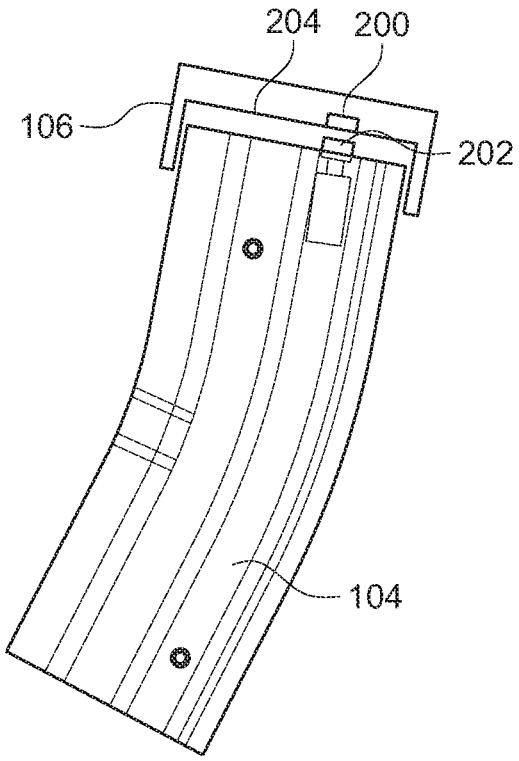
FIG. 3 is a sectional view of the magazine in a disengaged position according to an embodiment.

The magazine 104 may be released from the locking mechanism of the hand operated device 100 using a magazine release button 110. This allows the magazine 104 to drop from an engaged (loaded) position (shown in FIG. 2) to a disengaged (reload) position (shown in FIG. 3)

The hand operated device 100 may include a magazine housing sensor (or contact) 200, which when in contact with a magazine engagement sensor (or contact) 202 at the top of the magazine 104. The magazine housing sensor 200 relays to the simulation provided by the computer 100 whether or not the magazine is engaged, e.g., when the magazine engagement sensor is depressed against the existing roof 204 of the magazine housing 106.

Figure 4:
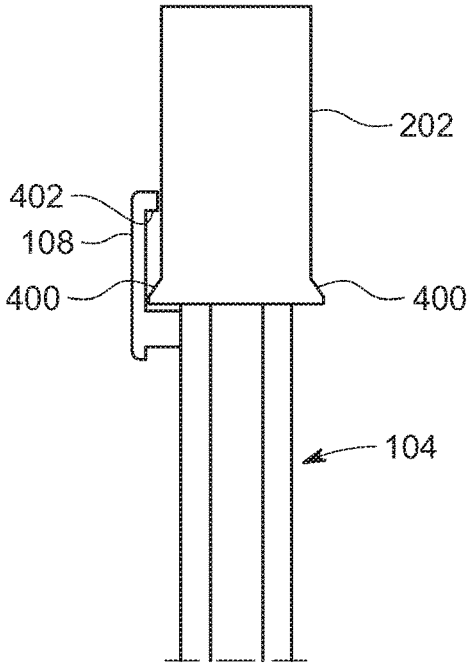
FIG. 4 is a sectional view of the magazine fully engaged in the magazine housing of the hand operated device according to an embodiment.

FIG. 4 shows the magazine in an engaged position in the magazine housing. The sensor(s)/contacts(s) 200, 202 relay to the simulation when the magazine 104 is ejected or disengaged (shown in FIG. 5) when the magazine housing sensor 200 and the magazine engagement sensor 202 indicate that the magazine 104 is released.

During the simulation of the user using the hand operated device 100, the user may operate the reload procedure of pressing the magazine release button 110 to drop the magazine and then pushing the magazine back into the magazine housing 106 to indicate to the simulation a reload has been performed. This advantageously enables the user to experience the physical sensation of loading and reloading a magazine in the hand operated device without the necessity of leaving the simulation to recover a dropped magazine.

Figure 5:
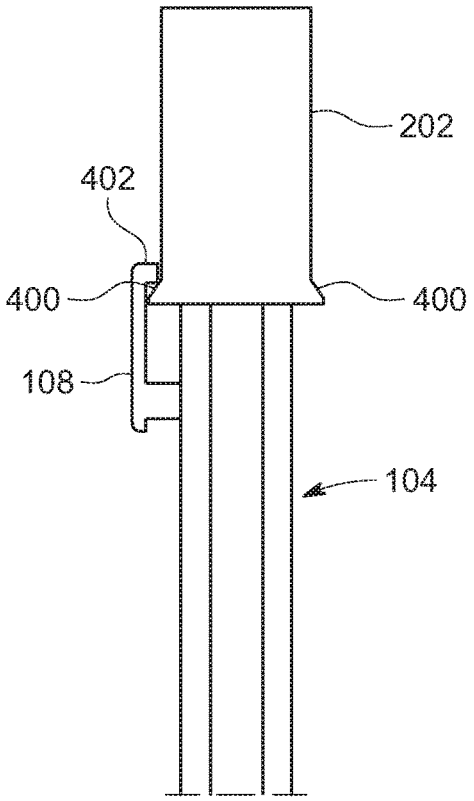
FIG. 5 is a sectional view of the magazine partially ejected from the magazine housing of the hand operated device according to an embodiment.

As shown in FIGS. 4 and 5, the magazine housing may include flanges 400. The magazine retention mechanism 108 may include interference flanges 402 to prevent the magazine from being fully released. The magazine retention mechanism 108 allows the magazine to slide back into place without impedance. Using this mechanism, the user may experience a more realistic sensation of changing magazines in the simulation.

The magazine retention mechanism is not limited to being external. In an embodiment, an internal version can be utilized where the retention mechanism catches within an internally routed path in the magazine housing. This will enable as the external version to drop the magazine, but not release it from within the housing.

Registering the engagement state of the magazine within the simulation is not limited to a push button switch, other types of switches or sensors could be incorporated to take its place such as but not limited to a proximity sensor.

This system is not limited to an external magazine as depicted in the figures. Internal magazines such as those found in handguns can also use this system for reload simulation.

The simulation mentioned can be any simulation that requires the knowledge of whether a magazine is engaged or ejected from a hand operated device. This includes, but is not limited to, a virtual firing simulation where the hand operated device is a weapon and the state of its reloading is required to be known.

The term "magazine" referenced herein is a generic term for any removable device which stores and loads any consumable necessary for discharging the hand operated device. Including, but not limited to, examples such as a magazine storing cartridges for a weapon, a magazine storing nails for a nail gun or a magazine storing charge for a futuristic weapon.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The present disclosure is to be considered as an exemplification of the invention, and is not intended to limit the invention to the specific embodiments illustrated by the figures or description below.

Some embodiments of the present invention are illustrated as an example and are not limited by the figures of the accompanying drawings, in which like references may indicate similar elements.

The invention claimed is:

1. An apparatus comprising:

a magazine housing;

a magazine;

a sensor operative to detect whether the magazine is fully engaged in the magazine housing;

a magazine release mechanism operative to disengage the magazine; and a magazine retention device operative to prevent the magazine from being fully ejected from the magazine housing when disengaged and retain the magazine in the magazine housing, and wherein the sensor is further operative to determine whether the magazine retained in the magazine housing is fully re-engaged.

2. The apparatus of claim 1, wherein the magazine retention device is connected to the magazine.

3. The apparatus of claim 2, wherein the magazine housing comprises an external flange and the magazine retention device comprises an interference flange configured to interact with the external flanges and prevent the magazine from being fully ejected from the magazine housing.

4. The apparatus of claim 1, wherein the magazine comprises an electrical contact operative to be depressed when the magazine is fully engaged in the magazine housing.

5. The apparatus of claim 1, wherein the magazine housing includes a roof, the roof comprising an electrical contact.

6. The apparatus of claim 5, wherein the magazine housing comprises the sensor to indicate whether the magazine is fully engaged.

7. The apparatus of claim 1, wherein the magazine release mechanism comprises an eject button.

* * * * *